US005376288A

United States Patent [19]

Falholt et al.

[11] Patent Number: 5,376,288

[45] Date of Patent: Dec. 27, 1994

[54] DETERGENT ADDITIVE GRANULATE AND DETERGENT

[75] Inventors: Per Falholt, Gentofte; Erik K. Markussen, Varloese, all of Denmark

[73] Assignee: Noro Nordisk A/S, Bagsvaerd, Denmark

[21] Appl. No.: 68,802

[22] Filed: May 28, 1993

Related U.S. Application Data

[63] Continuation of Ser. No. 773,181, Oct. 8, 1991, abandoned.

[30] Foreign Application Priority Data

Jun. 21, 1989 [DE] Germany ..... 3062/89

[51] Int. Cl.[5] ..... C11D 3/386

[52] U.S. Cl. ..... 252/95; 252/174.23; 252/174.13; 8/103; 8/110; 8/111

[58] Field of Search ..... 252/95, 174.12, 174.13; 8/103, 110, 111

[56] References Cited

U.S. PATENT DOCUMENTS

| | | | |
|---|---|---|---|
| 3,927,967 | 12/1975 | Speakman | 8/103 |
| 4,033,718 | 7/1977 | Holcombe et al. | 8/103 |
| 4,044,806 | 6/1978 | Wices | 252/102 |
| 4,217,105 | 8/1980 | Goodman | 8/111 |
| 4,556,874 | 1/1986 | Hölzle et al. | 8/103 |
| 4,767,557 | 8/1988 | Herdemann | 252/174.13 |
| 4,990,280 | 2/1991 | Thorengaard et al. | 252/174.13 |

FOREIGN PATENT DOCUMENTS

| | | |
|---|---|---|
| 0087833 | 9/1983 | European Pat. Off. . |
| 01197466 | 9/1984 | European Pat. Off. . |
| 8707292 | 12/1987 | WIPO . |
| 8908694 | 9/1989 | WIPO . |
| 8908695 | 9/1989 | WIPO . |
| 9015856 | 12/1990 | WIPO . |

*Primary Examiner*—Paul Lieberman
*Assistant Examiner*—Keary Fries
*Attorney, Agent, or Firm*—Steve T. Zelson; Elias J. Lambiris

[57] ABSTRACT

The detergent additive granulate is a coated co-granulate containing at least one enzyme and at least one photobleaching agent. If a detergent, a component of which is such detergent additive granulate, is used for laundering, the photobleaching agent will not tend to adhere selectively to the laundry during the initial washing process.

13 Claims, No Drawings

DETERGENT ADDITIVE GRANULATE AND DETERGENT

This application is a continuation application of co-pending application Ser. No. 07/773,181, filed Oct. 8, 1991, now abandoned the contents of which are incorporated herein by reference.

The concept of incorporation of a photobleaching agent in a detergent is known, reference being made to e.g. DE 3430773, EP 119746 and EP 87833. The photobleaching agent is inactive if not exposed to UV light and, thus, under normal conditions, the photobleaching agent will first be activated and function as a bleaching agent when the clean laundry is dried in the open. This is a clear advantage over the detergents with a normal bleach, which will function as a bleaching agent already in the washing solution and thus damage sensitive detergent additives, especially enzymes.

The introduction of photobleaching agents in detergents in solid form is not without problems, though. During the initial stages of the washing process, when the solid detergent agent is introduced into the washing float, particles of pure photobleaching agent or particles of detergent additives, which contains photobleaching agents at the surface thereof, will tend to adhere to the laundry due to a selective adhesion ability of the photobleaching agent to the laundry, and also such photobleaching agent will tend to stay with the laundry without being dissolved during the washing process. Most photobleaching agents possess a very intense color, and such photobleaching agents will create a most undesirable staining of the laundry. In case the photobleaching agent is colorless, the above indicated attachment thereof to the laundry daring the washing process will create an uneven concentration of photobleaching agent on the laundry, and in that case an uneven overbleaching action will take place when the laundry is dried in the open.

Thus, there is a need for a detergent additive in solid form comprising a photobleaching agent, whereby during the initial washing process the photobleaching agent will not tend to adhere selectively to the laundry.

Now, according to the invention it has been found that a detergent additive granulate of a special composition will fulfil the above objective.

Thus, the detergent additive granulate according to the invention is a co-granulate containing at least one enzyme and at least one photobleaching agent, the co-granulate being coated.

The photobleaching agent can be any photobleaching agent, e.g. Tinolux BBS, vide the following examples, zinc phthalocyanine sulfonate (ZPS) and aluminum phthalocyanine sulfonate (APS).

Tinolux and the later indicated materials Arbocel, Speswhite and Glascol are trademarks.

The detergent additive granulate according to the invention will fulfil the above objective in an especially advantageous manner, if produced by means of a drum granulator, as will later be described in more detail.

The detergent additive granulate can and will usually contain other components besides the components listed above, provided that these components do not damage the enzyme and/or the photobleaching agent.

In GB 2.179.053 an aqueous fabric washing detergent is described, which can contain both enzymes and a photobleaching agent. However, this detergent is aqueous, and the above problem, which is solved according to the invention, does not appear at all in relation to aqueous detergents, which exhibit other problems, e.g. stability problems.

EP 119.746 describes a detergent powder which contains both photobleach and enzyme. The first step during the production of this washing powder is the formation of the aqueous crutcher slurry, consisting of surfactants, builders, fillers and a solution of the photobleach. This crutcher slurry is spraydried, whereby the so-called base powder is formed. The enzyme which may optionally be added (vide page 4, line 29 in EP 119.746) has to be added as enzyme containing particles separate from the base powder, due to the fact that the enzyme activity in the base powder would be reduced severely or lost completely, if the enzyme was added to the crutcher solution. Thus, the EP 119.746 contains enzyme free, photobleaching agent containing particles and photobleaching agent free enzyme containing particles. It has been found that the problem of staining and overbleaching is not completely solved in relation to this prior art washing powder.

DE 28 13 198 describes a bleaching agent which contains a special photoactivator. This bleaching agent is produced by co-granulation of all constituents of the bleaching agent to a co-granulate or by granulation of a single constituent on a basis detergent component, whereas according to the invention two sensitive constituents of the detergent are selected, i.e. the enzyme and the photobleaching agent, and co-granulated.

The detergent additive granulate according to the invention can be produced by co-granulation in many ways, e.g. as indicated in the following.

I. A co-granulate of the so-called T-granulate type, as described in U.S. Pat. No. 4,106,991 (Novo Nordisk A/S, Denmark), i.e. with cellulose fibres.

II. A co-granulate corresponding to U.S. Pat. No. 4,661,452 (Novo Nordisk A/S, Denmark).

III. A co-granulate of the core type, as described in DK 4368/88. In this case it is specially preferred that the photobleaching agent is part of the core and that the enzyme is part of the coating.

IV. A co-granulate of the type described in DK 4369/88. In this case the photobleaching agent is added with the concentrated enzyme solution.

V. A co-granulate of the so-called "Marumerizer" type, as described in GB 1,362,365.

VI. A co-granulate of the prill type.

VII. A co-granulate of the Sparks type, as described in WO 85/05288.

VIII. A co-granulate of the fluid bed type.

In all cases the photobleaching agent is added as an aqueous solution, preferably as part of the granulation water.

In relation to the detergent additive granulate according to the invention the usual coating agents may be used, e.g. the coating agents described in WO 87/07292, WO 89/08694 and WO 89/08695.

In a preferred embodiment of the detergent additive granulate according to the invention the enzyme is one or more of the enzymes protease, amylase, lipase, cellulase, oxidase and amidase. These are the most common enzymes used in the detergent additive.

In a preferred embodiment of the detergent additive granulate according to the invention between 2 and 40% w/w of cellulose fibres are incorporated into the granulate. A granulate of this kind can be produced according to U.S. Pat. No. 4,106,991 (Novo Nordisk A/S, Denmark). In this manner a dust free granulate is obtained which can easily be produced in an industrial scale.

Also, the invention comprises a detergent which contains the detergent additive granulate according to the invention.

In a preferred embodiment of the detergent according to the invention the concentration of the detergent additive is between 0.05 and 5% w/w. In this manner the object of the invention is fulfilled, and also, the photobleaching effect is fully satisfactory.

In the following the production of the detergent additive granulate is illustrated in Examples 1, 4, 5, 7, 9 and 10, and the use of the detergent additive granulate is illustrated in Example 11.

EXAMPLE 1

A powder mixture containing a proteolytic enzyme and with the following composition 8.0 kg of SAVINASE® with an activity of 36.1 KNPU/g
6.0 kg of fibrous cellulose Arbocel BC 200
1.6 kg of kaolin, Speswhite ECCI
2.4 kg of carbohydrate binder and
20.6 kg of finely ground sodium sulphate is transferred to a 130 liter Lödige mixer FM 130 and granulated with 9.7 kg of a granulation liquid made up by mixing 2.0 kg of Tinolux BBS (liquid), Ciba-Geigy
0.9 kg of carbohydrate binder and
7.0 kg of water all other conditions during the granulation being identical to Example 1 in U.S. Pat. No. 4,106,991 (Novo Nordisk A/S, Denmark).

KNPU is an activity unit for proteolytic activity, described in the document AF 220/1-GB, KLU is an activity unit for lipolytic activity, described in the document AF 95/5, CSU is an activity unit for cellulolytic activity, described in the document AF 187/3, and KNU is an activity unit for amylolytic activity, described in the document AF 207/1, whereby all the cited documents are available on request from Novo Nordisk, Novo Allé, DK-2880 Bagsvaerd, Denmark.

Tinolux BBS is a photobleaching agent, which is a derivative of tetrabenzo-tetraazaporphine.

The moist granulate is dried on a fluid bed to a water content below 1% and the sieve fraction of the granulate between 300 μm and 900 μm is taken out as a product. This product is coated with 6.2% of polyethylene glycol (PEG 4000) and 10% of kaolin (Speswhite, ECC) by means of the method described in Example 22 in U.S. Pat. No. 4.106.991 (Novo Nordisk A/S, Denmark).

By means of usual fluid bed techniques, the granulate is further provided with a film coating consisting of 170 ppm of duasynic acid green and 0.25% of hydroxypropyl cellulose.

The final preparation exhibited a proteolytic activity of 5.7 KNPU/g.

EXAMPLE 2

A powder mixture containing a lipolytic enzyme and with the following composition 0.75 kg of LIPOLASE® with an activity of 860 KLU/g
2.25 kg of fibrous cellulose Arbocel BC 200
1.50 kg of bentonite ECCI ASB350
0.90 kg of carbohydrate binder and
8.90 kg of finely ground sodium sulphate is transferred to a 50 liter Lödige mixer FM 50 and granulated with 3.4 kg of a granulation liquid made up by mixing 0.7 kg of Tinolux BBS
0.7 kg of carbohydrate binder and
2.0 kg of water.

The granulation is carried out as described in Example 1, except for the size of the mixer.

The granulate is dried and sifted as described in Example 1, whereby a granulate with an activity of 31.2 KLU/g is obtained.

EXAMPLE 3

A powder mixture containing a cellulolytic enzyme and with the following composition 3.00 kg of cellulase with an activity of 5340 CSU/g
2.25 kg of fibrous cellulose Arbocel BC 200
0.60 kg of kaolin ECCI Speswhite
0.60 kg of carbohydrate binder and
8.85 kg of finely ground sodium sulphate is transferred to a 50 liter Lödige mixer FM 50 and granulated with 3.4 kg of a granulation liquid made up by mixing 0.83 kg of Tinolux BBS
0.30 kg of carbohydrate binder and
3.00 kg of water.

The granulation is carried out as described in Example 1, except for the size of the mixer.

The granulate is dried and sifted as described in Example 1.

EXAMPLE 4

1 kg of dry sifted (300–1000 μm) granulate produced as described in Example 2 is coated in a 5 liter Lödige mixer according to the method described in U.S. Pat. No. 4,106,991 (Novo Nordisk A/S, Denmark), example 22.

| | | |
|---|---|---|
| Prep. 4A | 1. coating layer | 5.0% PEG 4000 |
| | 2. coating layer | 10.0% kaolin |
| | 3. coating layer | 2.0% PEG 4000 |
| Prep. 4B | 1. coating layer | 5.0% hydrogenated tallow |
| | 2. coating layer | 10.0% kaolin |
| | 3. coating layer | 2.0% hydrogenated tallow |
| Prep. 4C | 1. coating layer | 5.0% hydrogenated tallow |

EXAMPLE 5

1 kg of dry sifted (300–1000 μm) granulate produced as described in Example 3 is coated as described in Example 4.

| | | |
|---|---|---|
| Prep. 5A | 1. coating layer | 5.0% PEG 4000 |
| | 2. coating layer | 10.0% kaolin |
| | 3. coating layer | 2.0% PEG 4000 |
| Prep. 5B | 1. coating layer | 5.0% hydrogenated tallow |
| | 2. coating layer | 10.0% kaolin |
| | 3. coating layer | 2.0% hydrogenatad tallow |
| Prep. 5C | 1. coating layer | 4.0% hydrogenated tallow |

EXAMPLE 6

5.0 kg of base granulate produced as described in U.S. Pat. No. 4,106,991 (Novo Nordisk A/S, Denmark), example 1, except that it is based on sodium sulphate as the inert diluent, is provided with a photobleach containing layer by means of a fluidized bed spraying technique, as follows.

With simultaneous drying in a Glatt fluid bed coater of type WSG5 the 5 kg of base granulate is sprayed with an emulsion/suspension consisting of 0.75 kg of Tinolux BBS
0.50 kg of Bentonite ASB350 (ECCI)
0.25 kg of Glascol LS22P (Styrene-acrylic copolymer, 45% microemulsion, Allied Colloids) and
2.00 kg of water and with proper selected air inlet and outlet temperature and atomizing air pressure that leaves every single enzyme granulate particle coated with a layer of dry Tinolux and bentonite with Glascol as the binding agent.

EXAMPLE 7

5 kg of a Tinolux/bentonite coated granulate produced as described in Example 6 is further coated with 100 g of bentonite and 45 g of Glascol LS22P (dry matter) by spraying with an emulsion/suspension consisting of 100 g of bentonite ASB 350
100 g of Glascol LS22P (45% microemulsion) and
500 g of water by means of the same fluidized bed coating technique as described in Example 6.

EXAMPLE 8

5.0 kg of base granulate produced as described in U.S. Pat. No. 4,106,991 (Novo Nordisk A/S), example 1, except that it is based on sodium sulphate as the inert diluent, is coated with a photobleach layer by means of a fluidized bed spraying technique.

With simultaneous drying in a Glatt fluid bed coater of type WSG5 the 5 kg of base granulate is sprayed with 0.75 kg Tinolux BBS with proper selected air inlet and outlet temperature and atomizing air pressure that leaves every single enzyme granulate particle coated with a layer of dry Tinolux photobleach.

EXAMPLE 9

5 kg of a Tinolux coated granulate produced as described in Example 8 is further coated with 200 g of bentonite and 135 g of Glascol LS22P (dry matter) by spraying with an emulsion/suspension consisting of 200 g of bentonite ASB 350
300 g of Glascol LS22P (45% microemulsion) and
1000 g of water by means of the same fluidized bed coating technique as described in Example 6.

EXAMPLE 10

A powder composition containing an amylolytic enzyme and with the following composition is prepared for extrusion according to Example 4 in U.S. Pat. No. 4,661,452 (Novo Nordisk A/S, Denmark).

0.500 kg of BAN with an activity of 4900 KNU/g
0.100 kg of titanium dioxide
0.275 kg of a carbohydrate binder
0.500 kg of calcium carbonate, Sturcal L
0.350 kg of anhydrous calcium sulphate
0.125 kg of sodium carboxymethyl cellulose, Hercules 7 H and
2.725 kg of finely ground sodium sulphate by spraying with 600 g Tinolux BBS containing 100 g of PVP K30 and finally spraying the moist mixture with 200 g of coconut monoethanol amide.

The hot (55° C.) moist mixture is extruded using a pellet press type extruder (Simon-Heesen type Monoroll Labor). To obtain an extrudate with a string diameter of 0.8 mm the original Simon-Heesen pellet die with 8 mm holes is equiped with a screen plate with 0.8 mm holes on the inside, which screen is supported by the die.

After extrusion the extrudate is allowed to cool by blowing cold air through it. After cooling to room temperature it is transferred to the Marumerizer®, which breaks the extrudate to a short sized noodle like product, which is compact and exhibits a well rounded surface. Finally the product is dried in a fludized bed drier.

The product is coated with a protective coating as described in example 22 of U.S. Pat. No. 4,106,991 (Novo Nordisk A/S, Denmark) or in WO 89/08694 (Novo Nordisk A/S, Denmark) or in WO 89/08695 (Novo Nordisk A/S, Denmark).

Depending on formulation and extruder type products with particle shapes ranging from pure spheres to short rod like shapes can be produced. Methods for production of spheronized/marumerized products are described in GB 1,362,365 (Novo Nordisk A/S, Denmark) and U.S. Pat. No. 4,661,452 (Novo Nordisk A/S, Denmark).

EXAMPLE 11

This example is a spotting example illustrating the use of the detergent additive granulate according to the invention.

Granules from Example 1 are added to a solution of a standard powder detergent in a jar. A piece of white cotton textile is placed on the bottom of the jar. The spotting from the granules on the white textile is evaluated after 1 minute according to the grades shown in the legend.

| | |
|---|---|
| Dosage of Tinolux 0.02% | |
| Invention | −− |
| Prior art | − |
| Fluid bed granulate*) | + |
| Dosage of Tinolux 0.04% | |
| Invention | −− |
| Prior art | − |
| Fluid bed granulate*) | + |

Legend:
−− absent spotting
− just detectable spotting
−+ clearly detectable spotting
+ significant spotting
++ very significant spotting
*)This prior art fluid bed granulate is produced by addition of the photobleach to a salt carrier in a fluidized bed.

We claim:

1. A detergent additive granulate which is a co-granulate comprising an enzyme and a photobleaching agent, wherein the co-granulate is covered with a coating, wherein the coating comprises a coating agent selected from the group consisting of polyethylene glycol, hydroxypropyl cellulose, hydrogenated tallow, and styrene-acrylic copolymer.

2. The detergent additive granulate according to claim 1, wherein the coating agent is polyethylene glycol.

3. The detergent additive granulate according to claim 1, wherein the coating agent is hydroxypropyl cellulose.

4. The detergent additive granulate according to claim 1, wherein the coating agent is hydrogenated tallow.

5. The detergent additive granulate according to claim 1, wherein the coating agent is styrene-acrylic copolymer.

6. The detergent additive granulate according to claim 1, wherein said coating agent is present in an amount of 0.9–7 % by weight of the granulate.

7. The detergent additive granulate according to claim 1, wherein the coating comprises a powder selected from the group consisting of bentonite, titanium dioxide, and kaolin.

8. The detergent additive granulate according to claim 7, wherein said powder is present in an amount of 2–10 % by weight of the granulate.

9. The detergent additive granulate according to claim 1, wherein the photobleaching agent is selected from the group consisting of phthalocyanine sulphonate and derivatives of tetrabenzo-tetraazaporphine.

10. The detergent additive granulate according to claim 1, wherein the enzyme is selected from the group consisting of protease, amylase, lipase, cellulase, oxidase and amidase.

11. The detergent additive granulate according to claim 1, wherein the granulate contains between 2 and 40% w/w of cellulose fibers.

12. A detergent composition comprising the detergent additive granulate according to claim 1.

13. The detergent composition according to claim 12, wherein the concentration of the detergent additive is between 0.05 and 5% w/w.

* * * * *